US009531083B2

(12) United States Patent
Gottl et al.

(10) Patent No.: US 9,531,083 B2
(45) Date of Patent: Dec. 27, 2016

(54) SUPPLY NETWORK FOR A GROUP ANTENNA

(75) Inventors: Maximilian Gottl, Frasdorf (DE); Michael Boss, Riedering (DE)

(73) Assignee: KATHREIN-WERKE KG, Rosenheim (DE)

( * ) Notice: Subject to any disclaimer, the term of this patent is extended or adjusted under 35 U.S.C. 154(b) by 1124 days.

(21) Appl. No.: 12/681,678

(22) PCT Filed: Sep. 25, 2008

(86) PCT No.: PCT/EP2008/008159

§ 371 (c)(1),
(2), (4) Date: Apr. 5, 2010

(87) PCT Pub. No.: WO2009/046886

PCT Pub. Date: Apr. 16, 2009

(65) Prior Publication Data

US 2012/0098726 A1 Apr. 26, 2012

(30) Foreign Application Priority Data

Oct. 5, 2007 (DE) ..... 10 2007 047 741

(51) Int. Cl.
*H01Q 21/08* (2006.01)
*H01Q 21/00* (2006.01)

(52) U.S. Cl.
CPC ..... *H01Q 21/0006* (2013.01)

(58) Field of Classification Search
CPC .. H01Q 21/065; H01Q 21/006; H01Q 21/243; H01Q 21/08
USPC ..... 343/753, 754, 850, 853, 708, 797, 751,343/893, 844, 876, 824
See application file for complete search history.

(56) References Cited

U.S. PATENT DOCUMENTS

| | | | | |
|---|---|---|---|---|
| 3,277,481 | A * | 10/1966 | Robin et al. | 342/373 |
| 3,701,157 | A * | 10/1972 | Uhrig | 343/708 |
| 3,996,592 | A * | 12/1976 | Kline | H01Q 3/44 343/817 |
| 4,758,685 | A * | 7/1988 | Pote et al. | 174/29 |
| 5,187,329 | A * | 2/1993 | Bleich et al. | 174/113 R |
| 6,147,658 | A * | 11/2000 | Higashi et al. | 343/853 |
| 6,268,828 | B1 * | 7/2001 | Martek | 342/373 |
| 6,573,875 | B2 * | 6/2003 | Zimmerman et al. | 343/853 |

(Continued)

FOREIGN PATENT DOCUMENTS

| | | |
|---|---|---|
| CN | 1638190 A | 7/2005 |
| DE | 40 35 793 | 5/1992 |

(Continued)

OTHER PUBLICATIONS

PIC Wire & Cable, "Velocity Factor", http://www.picwire.com/technical/velocity_factor.php, Jul. 19, 2013, 5 pages.

*Primary Examiner* — Dameon E Levi
*Assistant Examiner* — Hasan Islam
(74) *Attorney, Agent, or Firm* — Nixon & Vanderhye P.C.

(57) ABSTRACT

A group antenna has at least two transducers disposed offset from one another. A network is provided to supply the transducers. The network comprises coaxial cables running between a distributor and/or summation circuit and the access, connection, and/or supply points of the associated transducer. The network comprises at least two different types of coaxial cable characterized by different phase velocities.

16 Claims, 6 Drawing Sheets

(56) References Cited

U.S. PATENT DOCUMENTS

| | | | | |
|---|---|---|---|---|
| 6,720,934 | B1 * | 4/2004 | Price et al. | 343/801 |
| 6,806,845 | B2 * | 10/2004 | Fund et al. | 343/853 |
| 6,816,668 | B2 * | 11/2004 | McDonald et al. | 392/375 |
| 6,912,777 | B2 * | 7/2005 | Carlson et al. | 29/828 |
| 6,992,632 | B1 * | 1/2006 | Mohuchy | 343/700 MS |
| 7,026,892 | B2 | 4/2006 | Kajiya | |
| 2004/0038714 | A1 * | 2/2004 | Rhodes et al. | 455/562.1 |
| 2004/0135736 | A1 | 7/2004 | Fund et al. | |
| 2005/0001778 | A1 | 1/2005 | Le et al. | |
| 2005/0134404 | A1 | 6/2005 | Kajiya | |
| 2005/0179610 | A1 * | 8/2005 | Le et al. | 343/797 |

FOREIGN PATENT DOCUMENTS

| | | |
|---|---|---|
| DE | 101 50 150 | 5/2003 |
| EP | 0 582 013 | 2/1994 |

* cited by examiner

SUPPLY NETWORK FOR A GROUP ANTENNA

This application is the U.S. national phase of International Application No. PCT/EP2008/008159 filed 25 Sep. 2008, which designated the U.S. and claims priority to German Application No. DE 10 2007 047 741.6 filed 5 Oct. 2007, the entire contents of each of which are hereby incorporated by reference.

The invention relates to a feed network for a group antenna according to the preamble of claim 1.

The term group antenna is known to mean an antenna in which a plurality of radiators or radiator modules are arranged at a separation from each other at least in one column (or even one row). Such a group antenna (also known generally as an antenna array) can additionally, however, also comprise a plurality of radiators, i.e. radiator elements or radiator device or radiator modules, that are spaced apart in a horizontal and vertical direction. In the mobile communications sector, single-column, two-column or multi-column antenna arrays, for example, are often employed. Here, the individual radiators used may be e.g. dipoles and patch antennas. Single-polarised radiators or dual-polarised radiators may be used, which can radiate and/or receive only in one frequency band or generally in a plurality of frequency bands.

The present group antenna (antenna array) is preferably an antenna for the base station of a fixed mobile communications antenna.

It is known that in a group antenna, all the radiators must be fed with a defined relative phase. Where all the radiators are fed in-phase (co-phase feed), a linear group of radiator elements radiates perpendicular to the arrangement, i.e. usually perpendicular to a reflector arrangement, on which the individual radiators are arranged at a suitable distance. A constantly increasing phase difference of two adjacent radiators, on the other hand, causes stewing of the beam. Using adjustable phase shifters, the individual radiators, for example arranged one above the other in the vertical direction, can be fed suitable signals having a mutually offset phase difference, with the result that various degrees of beam downtilt (or downtilt angle) can be set as a function of the variably definable phase difference. This principle is primarily used in mobile communications antennas having a vertical arrangement of radiators.

There are a range of approaches for feeding radiators in-phase.

The fundamental way to provide an in-phase feed to a plurality of radiators has always been to use lines, and in particular coaxial cables, that have the same line length (coaxial-cable length) from the central feed point (branch point) to all the radiators. In other words, some of the equal-length feed lines (coaxial lines) are therefore laid in loops from the branch point so that, despite the different distance between the branch point and the radiator concerned, the signals are applied to the radiators always with the same phase or same relative phase according to the set downtilt angle.

Where phasing lines are required, line lengths can also be used that have a multiple of a 360° phase. By this means it is likewise possible to provide at the feed point concerned of the respective radiators, absolute phase coincidence once again or a relative phase difference as a function of a phase difference, for example set via a phase shifter, to set a specific downtilt angle. This is only possible, however, at a single frequency, so that phase errors arise at different frequencies, which then result in unwanted distortions in the radiation pattern. Hence this principle cannot be applied to broadband antennas, or only to a very limited extent.

If phasing lines are required and the radiators can emit an inverted signal, for example by inverting the sense of the feed, one can use this to shorten the line lengths by 180°+n×360°, where n=0, 1, 2 . . . . The smallest frequency-dependent distortions in the radiation pattern are obtained when the line is shortened by only 180°.

In addition, there are also antennas, in particular also for the mobile communications sector, which are composed of "co-linear antennas" (for example the Kathrein type K 751 637 antenna). In such co-linear antennas, a plurality of radiators are fed in series from one end of a rigid, linear feed line. The radiators are located in this case in positions where the phase along the feed line differs by 360° for each position. It is again possible by this means to feed with the same phase all the radiators lying spaced apart from each other. If a feed line having a dielectric made of air is used, this position is spaced by one wavelength (of the frequency band to be transmitted, preferably in the centre frequency of the frequency band to be transmitted). Such a radiator spacing, however, may be too large for the requirement made of the radiation pattern. Hence the linear, fixed feed line is partially or entirely filled with a dielectric. The result of this is that the spaced locations of equal phase (each of which differ by 360° or a multiple of 360°) are hence brought closer together, whereby the distance between adjacent radiator positions is also correspondingly reduced. Furthermore, it is possible to steer the beam by adding or removing dielectric.

The object of the present invention is to feed the radiators and/or groups of radiators in a group antenna (an antenna array) with a definite phase, and to do this with a design that is better than the prior art.

The object is achieved according to the invention by the features given in claim 1. Advantageous embodiments of the invention are given in the subclaims.

Starting from the prior art, in which the individual lines, in particular in the form of coaxial cables, from a distribution point up to a feed point or branch point for the radiators or radiator elements or groups of radiators concerned, are composed of equally long coaxial cables irrespective of the actual separation of the distribution point and radiator element (with the consequence that phasing loops need to be laid to a relevant antenna), it is proposed according to the invention that the feed network for the group antenna comprising at least two radiators comprises at least two different types of coaxial cables, which allow the signals to propagate with different phase velocities.

This provides the major advantage that, in order to shorten phasing loops and, if applicable, even to avoid phasing loops in the feed line of a relevant radiator or of a subgroup of radiators, at least one section is provided with a coaxial cable that results in signal propagation at a lower phase velocity.

Hence, by using coaxial cables of different length, the required phases for the radiators fed via these cables can accordingly still be retained. This applies equally to an in-phase feed of a group or subgroups or even also to the case in which individual radiators or radiator groups are to be fed with a defined phase or with a defined phase difference, and where in this case, cable loops of different length normally need to be used in the prior art. Again in this case, the cable loops of different lengths can be shortened or avoided by using accordingly different coaxial cables having different phase velocities.

DE 40 35 793 A1 has disclosed the principle of a dielectric array antenna having an associated branching network in waveguide technology. According to this known antenna, an antenna having particularly small antenna groups with a minimised number of individual elements can be created in the array. According to this solution, which is completely unorthodox for standard antenna technology, it is provided that a feed signal shall be guided from a waveguide feed point via branched waveguide sections to individual waveguide outlet apertures, to which the radiator elements can then be connected.

The material used here for the waveguide is a metal such as brass, a brass/gold alloy or a plastic in which the waveguide walls are metallized. In practice, such a waveguide block is joined together from two symmetrical metal blocks, which are provided with the integrally formed waveguide channels of different lengths.

The five individual radiators described in this prior publication are driven in-phase by splitting the feed waveguide in the E-plane. The phase velocities in the waveguide and hence the effective electrical lengths of the waveguides used are varied by varying the waveguide width.

This relates to a completely different special solution, however. This is because waveguide feed networks are not normally used for antenna systems or mobile communications systems, not least because the waveguides would be far too large at the frequency bands in question for a technical implementation still to be tenable. Furthermore, implementing waveguide technology with a feed network rather than coaxial cables requires distinct specialist knowledge, which is why a person skilled in the art in the field of antennas using coaxial cables would not expect the field of waveguide technology to suggest ideas.

Moreover, the use of a metal block and the wave guide channels specifically formed therein is an individual solution that is in no way comparable to the laying of coaxial cables. In an antenna system, a coaxial cable can easily be guided around curves and loops usually in any length and over many different levels without intrinsically changing or even degrading the antenna characteristic.

In a preferred embodiment of the invention, a coaxial cable having a low phase velocity is used in the situation where the actual distance between a branch point and a feed point (at a radiator concerned or at a radiator group fed via this point) is shorter than the distance between the branch point and a radiator group lying adjacent to it or a radiator lying adjacent. In particular when using at least three radiators or radiator groups that are spaced apart from each other along a mounting direction, a coaxial cable having a low phase velocity is used in particular for the radiators or radiator groups provided in the central region of the radiator arrangement. The term "feed point" can be taken to mean every suitable connection of a radiator to a coaxial cable, i.e. any supply point and/or connection point between the radiator and coaxial feed cable. In other words, such a supply point or connection point, hence also a "feed input" or feed point, can be provided directly at dipole arms. Usually, however, matching elements such as capacitances, inductances, line segments having different characteristic impedances and wavelengths and even a stub are also used. In this case, the supply point, connection point and/or feed point may be provided before the aforementioned matching elements, i.e. at a distance in front of the actual radiator elements. Coaxial lines can also be used in splitters for impedance transformation and stubs. In addition, coaxial cables may also be present in the later stage of the feed, e.g. interconnected to form a filter. This is used in dual-band antennas to attenuate the signals of the other respective band. In other words, the at least one coaxial cable or the plurality of coaxial cables provided according to the invention (along which the phase of a wave propagates at a velocity that differs from the other coaxial cables provided in the network) is provided over the entire length or just part of a supply section or feed section, via which a radiator is fed by a splitter and/or combiner, i.e. transmit signals are emitted or receive signals received.

In a particularly preferred embodiment, at least three different coaxial cables having three different phase velocities are used, in particular when at least three spaced-apart radiators or radiator groups having a common feed are spaced apart from each other.

When using three or more radiators or radiator groups, which are fed with a definable or pre-selectable phase difference or which comprise subgroups, which are to be fed with a pre-selectable or definable phase difference, it is possible to shorten the cable loops appropriately or even avoid cable loops, for example, by using a plurality of different coaxial cables having different phase velocities (i.e. different speeds at which the phase of a wave propagates). In practice, many antennas have a symmetrical design about a central radiator or a central radiator group, so that when using three radiators (or three radiator groups), only one second type of coaxial cable is needed. In a network having five radiators or five radiator groups, a preferred solution according to the invention can then be implemented using three different coaxial cables (having different phase velocities).

In such group antennas designed according to the invention, it is still also possible to provide devices for phase shifting and/or power splitting. In particular, in the group antennas according to the invention it is also possible to provide not only phase shifters in the network for adjustable beam steering, but also means for adjustable power splitting.

Of course it is also possible in all cases that the cable length can be shortened by a multiple of a 360° phase, because this does not produce a change in phase. Using cables having lengths of n×360°, however, is only exactly correct for a single frequency. Different frequencies produce changes in the phase. The phase changes are proportional to the frequency difference and to the lost line length. Considering that an ever wider bandwidth is nowadays required of many antennas, this would mean that significant frequency differences are present that also contain phase errors. Irrespective of whether or not all phase errors are made in the same sense, they also lead to beam slewing and/or e.g. to a higher side-lobe level. The requirements made of the radiation pattern combined with the mentioned required bandwidth hence determine whether feed cables can be used in which the phase allows an additional 360° phase change or multiple additional 360° phase changes.

Finally, it is possible to combine inverting a radiated signal with shortening a cable length by 180°+n×360° phase, where n=0, 1, 2, . . . . "Inverting" a signal (i.e. emitting an inverted signal) means a frequency-independent phase shift of 180°. Radiating an inverted signal can be achieved for a dipole, for example, by swapping over the feed points or by completely rotating the dipole through 180°.

The coaxial cables having a different phase velocity can be realised by any suitable means. For example, it is possible to use coaxial cables having a special construction of the inner conductor for this purpose, whereby the phase velocity is changed. It is possible to use a helically arranged inner conductor, an inner conductor that undulates along its length, etc.

The different phase velocity for the coaxial cables can also be varied in principle by a special construction of the outer conductor, which can be made, for example, to have an undulating design or a design that undulates in a spiral etc.

The invention is explained below with reference to drawings, with some of the explanation also referring to solutions as were previously necessary according to the prior art, in which specifically:

Figure 8:
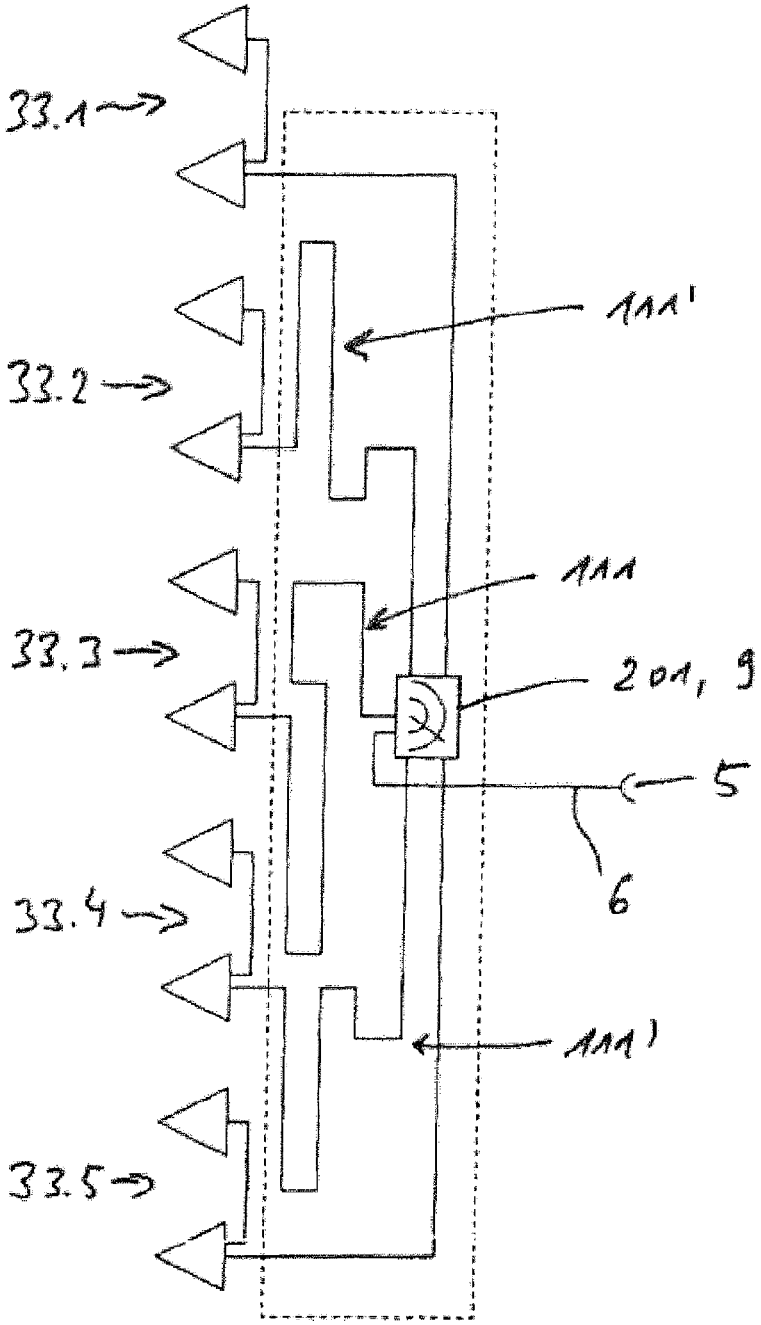
Fig. 8 Prior art
Figure 9:
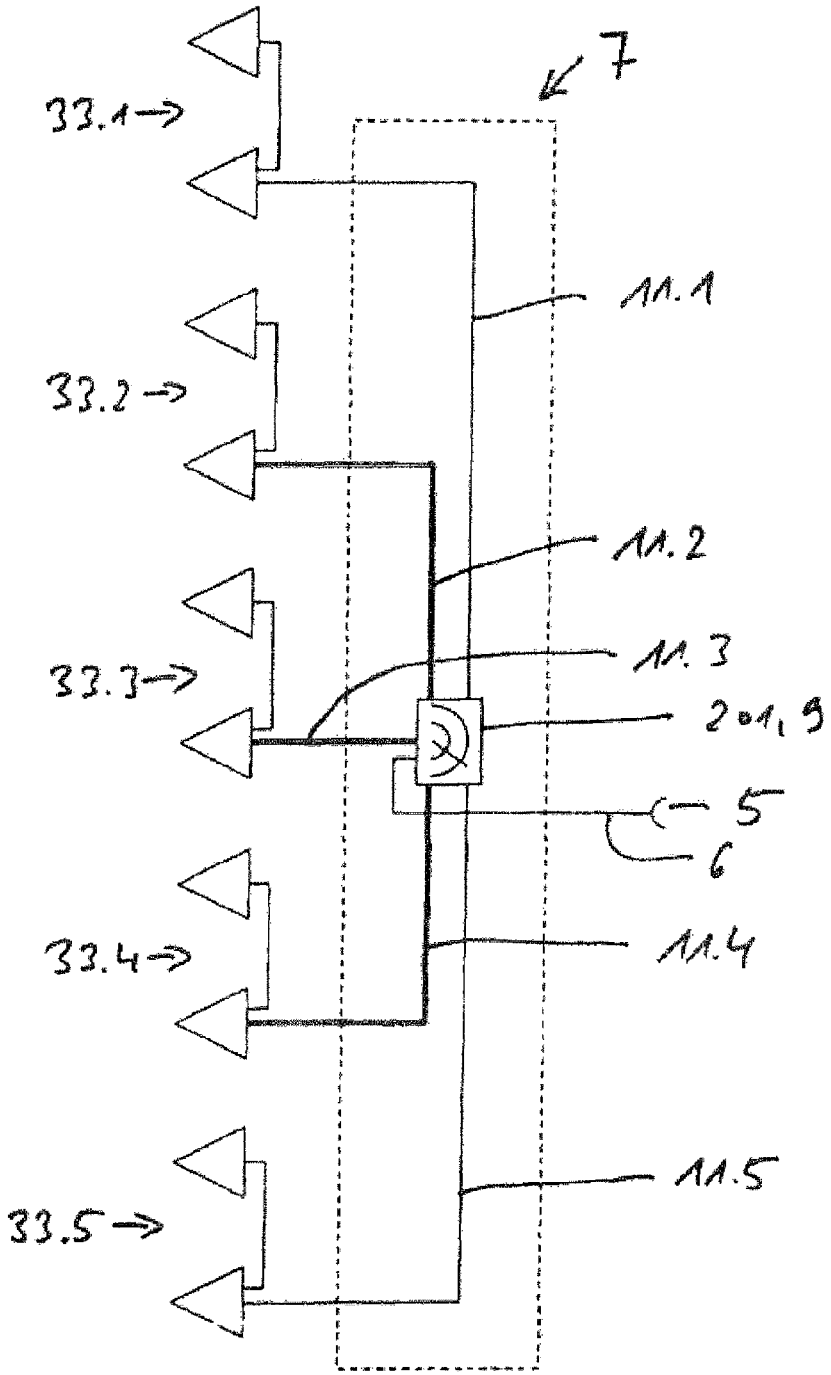

FIG. 8 shows a group antenna according to the prior art having a distribution network incorporating subgroups, with the radiators within the subgroups being fed in series in a manner according to the prior art; and FIG. 9 shows a group antenna according to the invention that is comparable to that of FIG. 8, in which the cable loops provided in FIG. 8 according to the prior art are not just reduced but actually dispensed with.

Figure 1:
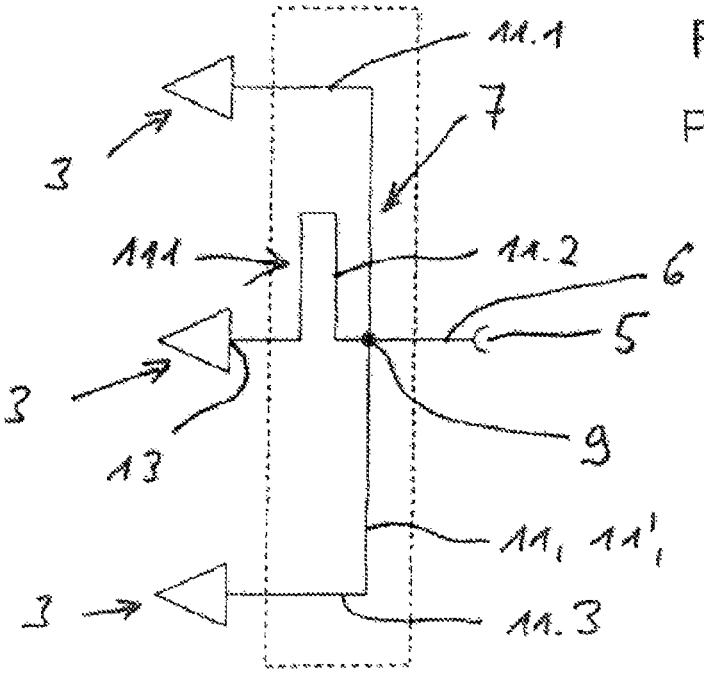
Fig. 1 Prior art
FIG. 1 shows a schematic side view of a group antenna according to the prior art having three radiators, preferably spaced, by way of example, at the same distance apart from each other in the vertical direction.

FIG. 1 shows in a schematic side view a group antenna (antenna array) according to the prior art. Such a group antenna can be used, for example, for the base station of a mobile communications antenna.

In the exemplary embodiment shown, the group antenna comprises three radiators 3 or radiator arrangements (they can also be radiator modules etc) that are spaced apart from each other. For a mobile communications antenna, these radiators 3 are usually arranged spaced at the same distance apart from each other in a vertical direction, typically in front of a reflector. The radiators 3 may be dipole radiators, patch radiators or other radiators. Single-polarised radiators or dual-polarised radiators may be used. In principle, the antenna can be designed so that it radiates or receives in one or more frequency bands.

In the exemplary embodiment shown, only a basic version is presented, for example for one polarisation. (For an additional polarisation, a suitable feed is provided via a parallel second network, where the two polarisations can be combined via a combiner. For radiators in a different frequency band, separate radiators usually having a separate network can likewise be provided.)

In the exemplary embodiment shown, a supply point or feed point 5 is provided for the network 7, where the network 7 has a splitter and/or combiner 9 connected via a line 6 to the supply point or feed point 5, from which splitter and/or combiner three lines 11', in particular three coaxial lines 11, are arranged between the splitter and/or combiner 9 and the respective feed input 13 at the radiator 3.

In order to ensure that all the radiators 3 are fed in-phase, the three lines 11'. i.e. in the exemplary embodiment shown the three coaxial lines 11, are formed from identical coaxial cables 11.1, 11.2 and 11.3 of the same length.

Figure 2:
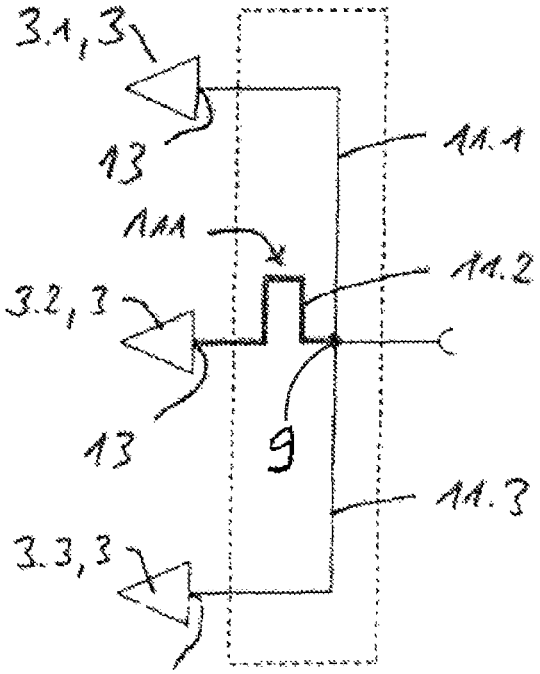
FIG. 2 shows a group antenna that is comparable to FIG. 1, in which, however, a radiator is fed according to the invention via a coaxial cable having a lower phase velocity, whereby a cable loop is shortened compared with the solution known from the prior art shown in FIG. 1.

In the exemplary embodiment according to the invention shown in FIG. 2 for an otherwise comparable group antenna 1, although the coaxial cable 11.1 and 11.3 leading to the upper and lower radiator 3.1 and 3.3 is of the same length and is made of a coaxial cable 11 of the same phase velocity, a coaxial cable 11.2 is now used between the splitter and/or combiner point 9 and the feed input 13 of the central radiator 3 that differs from this and that allows a lower phase velocity (i.e. a lower speed at which the phase of an electromagnetic wave propagates in the coaxial cable). For this reason, the cable loop 111 provided in FIG. 1 according to the prior art for the central coaxial cable 11.2 is now significantly shortened, for example by 10% to 90%, by 20% to 80%, by 30% to 70% or by 40% to 60% for instance. In the exemplary embodiment shown, it has been possible to shorten the length by about 50%. In the antenna arrangements that today often have a high cabling density, in particular mobile communications antenna arrangements, this provides a significant advantage, in particular a reduction in installation space and in costs.

In the exemplary embodiment shown in FIG. 2, a feed input or a feed point 13 is referred to, which theoretically for a dipole radiator can lie directly at the inner ends of two dipole arms. The radiator can, however, also comprise "internal coaxial cable lengths", in particular when intended matching elements are provided, such as capacitance and inductance, line sections now having different characteristic impedances and wavelengths, also with regard to a stub that may also be provided. In other words, the supply point, connection point and/or feed point may also lie at a distance from the actual radiator elements. Hence supply point, connection point and/or feed point is taken to mean a supply point, which is in no way restricted or limited, for a radiator. In addition, the coaxial cable in question having a reduced phase velocity need not be provided over the entire section from this supply point, connection point and/or feed point 13 and the splitter and/or combiner 9. It is sufficient if such a cable, if applicable, is only implemented over a sub-length and interacts with other coaxial cable sections that allow a phase to propagate at a phase velocity that differs from it.

In other words, the principle according to the invention is such that on a branch line running from a splitter and/or combiner 9 (i.e. a splitter and/or combiner point 9) and the at least two supply points, connection points and/or feed points 13 (which in turn can also be designed as a type of branching circuit, splitter and/or combiner to subsequent radiators), coaxial cables of different types and/or lengths are used in the one and/or the at least other coaxial branch line, these coaxial cables being of different length if applicable and characterised by a different phase velocity. The use of the coaxial cable type concerned, having a phase velocity concerned that differs from another coaxial cable type, and the corresponding length is always adjusted so that a desired and defined phase is produced at a supply point, connection point and/or feed point 13 for one and more subsequent radiators, and this is preferably done with shortest possible cable lengths to avoid cable loops. Hence a coaxial cable type having a defined phase velocity is preferably used in a coaxial cable branch line, at least over a sub-section, and a coaxial cable type having a phase velocity that differs from this is used in the other of the at least one additional coaxial branch line, at least over a sub-section. In particular, in the situation where the spatial distance between a splitter and/or combiner 9 and a supply point, connection point and/or feed point 13 of a radiator or a radiator group is shorter than to the supply point, connection point and/or feed point 13 of a radiator or a radiator group fed via the other coaxial branch line, it is possible to ensure that, by selecting a coaxial cable type having a slower phase velocity, the entire cable length can be chosen to be shorter in order to avoid the cable loops necessary in the prior art.

Figure 3:
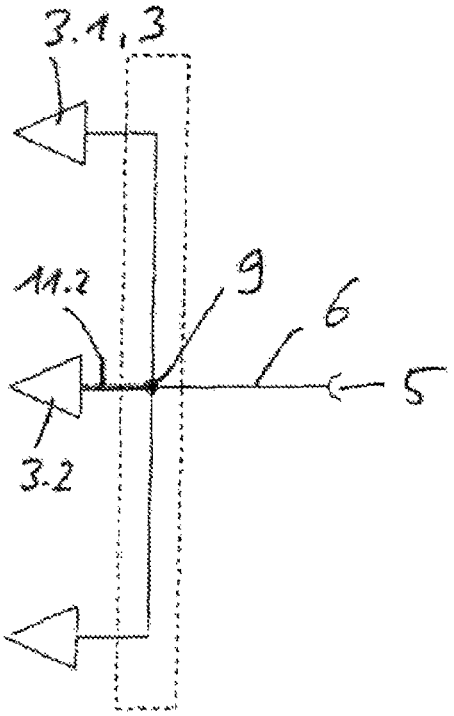
FIG. 3 shows another variation of FIG. 2, in which a cable loop is completely eliminated in the coaxial cable for feeding the central radiator.

In the exemplary embodiment of FIG. 3, an embodiment has been used for the coaxial cable 11.2 in which the coaxial cable 11.2 allows an even lower phase velocity, so that here a line and a feed cable 11.2 can be used without the need for any cable loop 111.

Even though in this exemplary embodiment the central coaxial cable 11.2 is significantly shorter than the two other coaxial cables 11.1 and 11.3, all three radiators 3.1 to 3.3 are fed with the same phase.

In the exemplary embodiment shown in FIG. 3, a power splitter 109 is also provided at the splitter and/or combiner 9. This is merely meant to indicate that by this means, for example, the power components for the individual radiators 3 may also be set to different levels if this appears necessary or useful. Unlike the exemplary embodiment shown, however, a power splitter 109 can also be provided at another position. In addition, a plurality of power splitters can also be provided at different points in the entire network. There are hence no restrictions in this respect.

Figure 4:
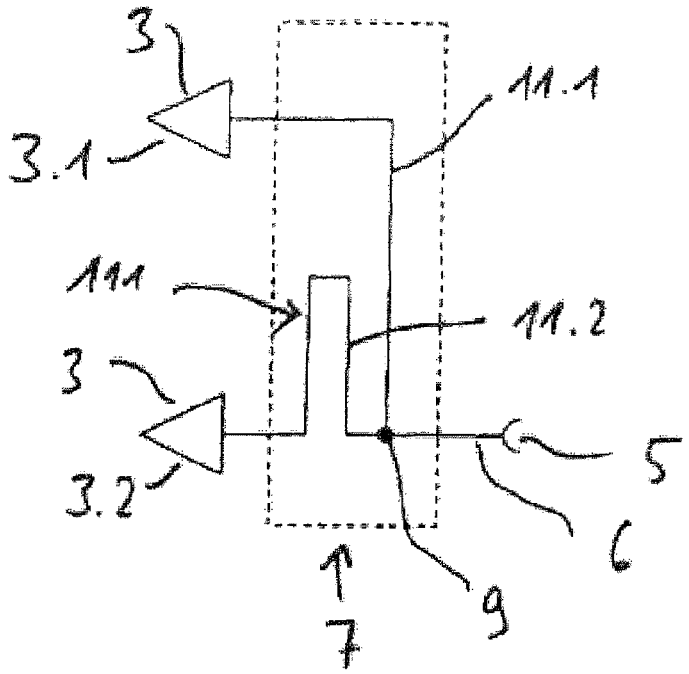
Fig. 4 Prior art
FIG. 4 shows a schematic side view of a group antenna according to the prior art having two radiators or radiator groups spaced apart from each other, with all the radiators being fed by the same coaxial cable length.

The exemplary embodiment shown in FIG. 4 differs from that of FIG. 1 only in that the lower third radiator 3.3 has been left out. It is also still necessary here for the feed to the second radiator 3.2 to have a coaxial cable 11.2 that is laid with a cable loop 111 so that this coaxial cable 11.2 is the same length as the coaxial cable 11.1 (because transmission in both cables is at the same phase velocity).

Figure 5:
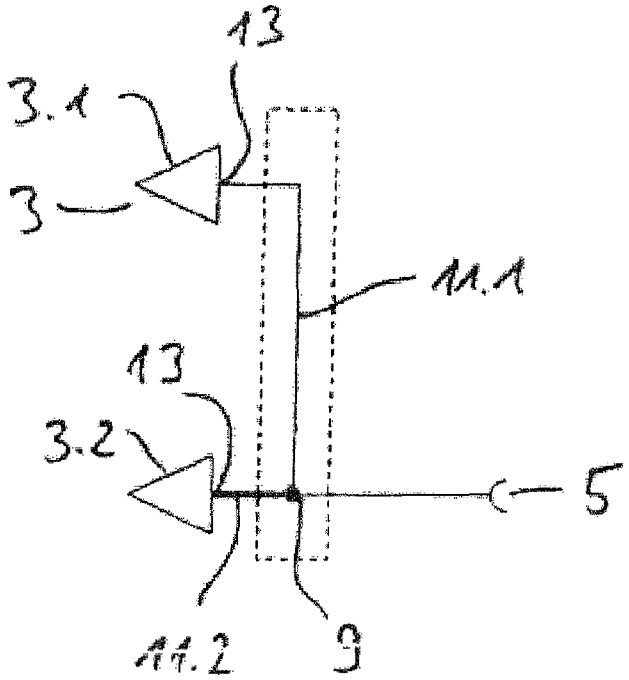
FIG. 5 shows a corresponding solution according to the invention is a variation of FIG. 4, in which the cable loop provided according to the prior art of the one radiator is completely eliminated.

In the contrasting embodiment according to the invention shown in FIG. 5, a coaxial cable 11.2 is used that differs from the coaxial cable 11.1 in that it has a significantly lower phase velocity. A cable loop 111, such as in the solution according to the prior art shown in FIG. 4, can thereby be avoided.

Figure 6:
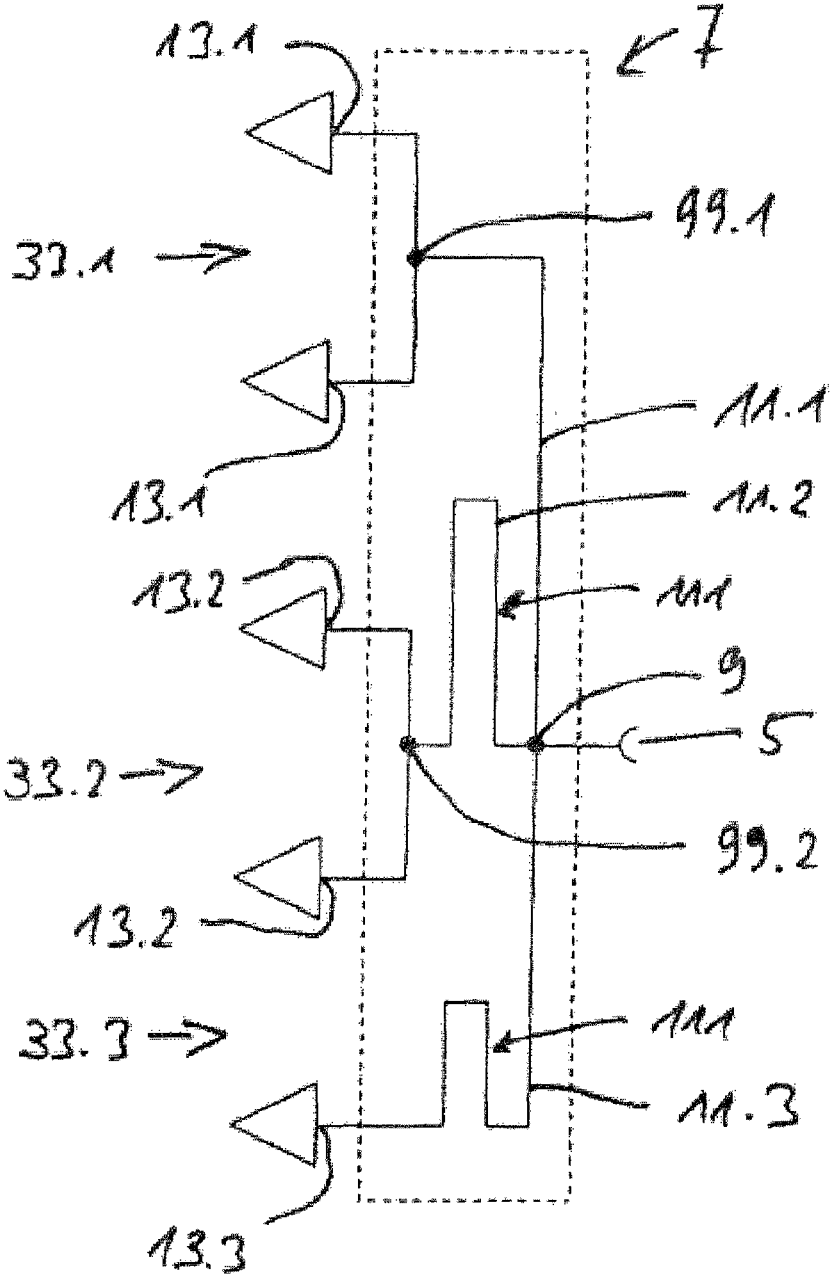
Fig. 6 Prior art
FIG. 6 shows a group antenna according to the prior art having a distribution network incorporating subgroups, which are fed with a different phase by using coaxial cables of different length between distribution point and the feed point of the radiators.

The exemplary embodiment shown in FIG. 6 is an embodiment having a distribution network 7 incorporating subgroups 33.1, 33.2 and 33.3, where the subgroup 33.1 and 33.2 comprises, for example, two radiators 3.1 and 3.2 respectively, and the third subgroup 33.3 comprises just one radiator 3.3. As a variation of the diagram shown in FIG. 6, the antenna groups 33.1 and 33.2 can also comprise more than just two radiators. The three mentioned coaxial cables 11.1, 11.2 and 11.3 in turn run from the mentioned splitter and/or combiner 9 to the two subgroups 33.1 and 33.2, which at a group point 99.1 and 99.2 again branch according to the number of radiators belonging to a subgroup.

The phase between the splitter and/or combiner 9 and the feed inputs 13.1 at the two radiators 3.1 of the first group 33.1, and at the inputs 13.2 and 13.3 for the single radiator 3.3 of the third group 33.3, is determined by the corresponding cable length. Identical cables having the same phase velocities are used here.

Figure 7:
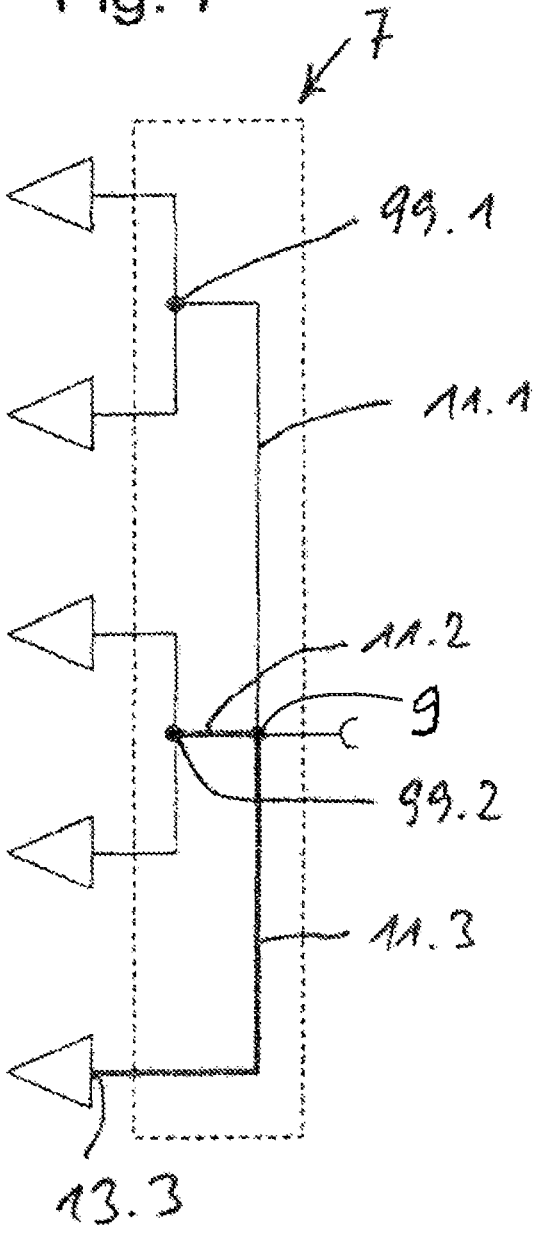
FIG. 7 shows a group antenna according to the invention that is comparable to that of FIG. 6, but using different coaxial cables having different phase velocities.

In contrast, in the antenna group shown in FIG. 7 and modified according to the invention, it is proposed to use between the splitter and/or combiner 9 and the subsequent splitters and/or combiners 99.1 and 99.2 assigned to the individual antenna groups, coaxial cable having a different phase velocity, where the coaxial cable 11.2 is a cable characterised by a lower phase velocity. In the exemplary embodiment shown, the coaxial cable 11.2 is chosen so that the phase of an electromagnetic wave (signal) in the coaxial cable 11.2 propagates at a velocity such that a cable loop 111 (FIG. 6) can be completely dispensed with. Alternative embodiments, in which it is possible at least to shorten and hence reduce in size the cable loop needed according to the prior art, are also possible and sometimes useful.

The coaxial cable 11.3 is used in a continuous run along the entire length from the splitter and/or combiner 9 to the feed input 13.3, and also has a preferably even lower phase velocity than the coaxial cable 11.2. It should also be pointed out here that between the branch point 9 and the feed points 13.2 of the radiators 3.2 of the second group, two coaxial cables of different type are hence connected one after the other, namely the coaxial cable 11.2 having a lower phase velocity, which then at the branch point 99.2 becomes a series-connected coaxial cable 11.2 having a higher phase velocity in comparison, which, for example, is the same as that type of coaxial cable 11.1 leading to the radiators 3.1. As already mentioned, the coaxial cables having, for example, a lower phase velocity, can also be provided only in a sub-section between the splitter and/or combiner 9 and any one supply point, connection point and/or feed point 13, so that hence coaxial cables that allow a phase to propagate at a different phase velocity, each in suitable lengths, are connected in series (one after the other), i.e. are electrically connected.

As has already been mentioned, the supply points, connection points and/or feed points 13 can also lie at a distance from the individual radiators 13. Hence, for instance, the additional branch point or branching circuit 99.9 can be taken to be a supply point, connection point and/or feed point 13 for the subsequent radiators 13.2. Also in the exemplary embodiment shown in FIG. 7, the coaxial cables having different phase velocities are drawn with thicker lines than the other coaxial cables having usually higher phase velocities. Also in this exemplary embodiment shown in FIG. 7, the coaxial cables having different phase velocities are likewise only provided on a sub-section, for example between the splitter and/or combiner point 9 and a supply point, connection point and/or feed point 13 or a subsequent splitter and/or combiner 99.2, especially as this additional branch point 99.2 ultimately again constitutes a supply point, connection point and/or feed point 13 for the one or more subsequent radiators 13. Along the sections or sub-sections 11.2 and 11.3 mentioned, it is possible, for example, also to interconnect coaxial cables or different coaxial cable types in an alternating arrangement of a plurality of cables to form a common transmission path.

The exemplary embodiment shown in FIG. 8 again shows a group antenna according to the prior art, where in this exemplary embodiment in all subgroups (although this need not be the case in all subgroups) the at least one additional radiator is fed in series. The connecting line inside the subgroups can be of any type, irrespective of the rest of the feed network. For instance linear lines, for which phase differences of 360° are equivalent to a distance of 0.7 wavelengths in air, are possible. In this exemplary embodiment, a phase shifter module 201 is also provided (namely a differential phase shifter module), where the radiator groups 33.1 and 33.5 lying at the extreme ends (i.e. furthest away) are fed with the largest relative phase shift, and the groups 33.2 and 33.4 adjacent to these and lying closer together are fed with a smaller relative phase offset via the two additional outputs in the dual-phase shifter module (reference is made to the prior publication EP 1 208 614 B1 and the contents of this application for information on the design and use of such a dual-phase shifter module and how it works).

The central radiator group 33.3 is usually fed without a phase offset via the feed point 6 and the subsequent feed line 5. In other words, the dual-phase shifter module 201 ultimately also doubles as the splitter and/or combiner 9 given in the other exemplary embodiments.

The antenna group according to the invention shown in FIG. 9 and which is a variation of FIG. 8 comprises the same radiators, radiator groups and basically the comparable layout for generating the comparable radiation pattern, but in this exemplary embodiment the central radiator group 33.3 is now fed by a coaxial cable 11.3 having a lower phase velocity in order to shorten the central loop 111 provided according to the embodiment according to the prior art shown in FIG. 8, and the radiators, of the second and fourth group, lying immediately above and below the central radiator and fed by the two outputs of the dual-phase shifter module via coaxial cables 11.2 and 11.4, are likewise fed via another coaxial cable having again a different phase velocity, so that the cable loops 111' provided for these modules as shown in FIG. 8 are also dispensed with.

For the individual coaxial cables 11.2 and 11.4, coaxial cable types are then chosen so that the coaxial cables can be laid as much as possible without using cable loops or using only cable loops of smallest possible dimensions. In other words, the coaxial cable type concerned must be chosen so that it has a phase velocity that is suitably adapted to the definable optimum length in order to ensure that the subsequent radiators are fed with the correct defined phase.

In order to provide coaxial cables having different phase velocities, all suitable and fundamentally possible measures can be used. For instance, the coaxial cables can have different dielectric constants in order to enable different phase velocities that vary according to the dielectric constant. The coaxial cables can, however, also alternatively or additionally be provided with different inner conductor constructions, for example having an inner conductor in the form of a helix and or comprising inner conductors with an undulating design. Finally, alternatively or additionally, the coaxial cables can also be provided with a different outer conductor construction, where the outer conductor can also preferably have an undulating design and/or a design that undulates in a spiral.

Other technical measures for changing the phase velocity are possible.

Finally, it should be pointed out that the mentioned coaxial cables 11 can be extended or shortened by a different phase offset, specifically by n×360°, where n=1, 2 . . . .

If the coaxial cables can emit an inverted signal, a phase shift of 180° is possible. Such cables can be extended or shortened by a corresponding phase offset, specifically by 180°+n×360°, where in this case again n=1, 2 . . . .

The invention claimed is:

1. Group antenna comprising:

a first radiator having a first radiator feed point;

a second radiator having a second radiator feed point, the second radiator being spaced apart from the first radiator;

a splitter or combiner; and a network configured for feeding the first and second radiators, the network comprising a first coaxial cable, which provides a first path between the splitter or combiner and the first radiator feed point and a second coaxial cable which provides a second path between the splitter or combiner and the second radiator feed point, wherein the first and second coaxial cables are connected in parallel to the splitter or combiner, the first coaxial cable comprising a first type of coaxial cable exhibiting a first phase velocity and the second coaxial cable comprising a second type of coaxial cable different from the first type of coaxial cable, the second type of coaxial cable exhibiting a second phase velocity different from the first phase velocity, the first coaxial cable exhibiting the first phase velocity over the first path, the second coaxial cable exhibiting the second phase velocity over the second path, the network being further configured to feed the first and second radiators with different phases, and at least one of the first and second coaxial cables having a low phase velocity at least over a sub-length in order to shorten the overall cable length between the splitter or combiner and the first or second radiator feed point.

2. Group antenna according to claim 1, wherein at least the first coaxial cable has a low phase velocity compared with at least the second coaxial cable that is provided over the entire length between the splitter or combiner and the first radiator feed point.

3. Group antenna according to claim 1, wherein at least the first coaxial cable has a low phase velocity compared with the second coaxial cable provided only over a sub-length of the first coaxial cable between the splitter or combiner and the first radiator feed point.

4. Group antenna according to claim 1, wherein the first radiator feed point lies at a shorter distance from the splitter or combiner located on a feed-line side than the second radiator feed point, and the more distantly located radiator feed point is connected to the feed line at least over a subsection by a coaxial cable having a lower phase velocity.

5. Group antenna according to claim 1, wherein at least the first coaxial cable has a lower phase velocity than the second coaxial cable such that radiators or radiator groups fed via it are fed without the need for a cable loop.

6. Group antenna according to claim 1, wherein the first and second coaxial cables having different phase velocities have different dielectric constants.

7. Group antenna according to claim 1, wherein the first and second coaxial cables having different phase velocities have different inner conductor constructions.

8. Group antenna according to claim 1, wherein the first and second coaxial cables having different phase velocities have different outer conductor constructions, where the outer conductor has an undulating design or a design that undulates in a spiral.

9. Group antenna according to claim 1, wherein the network further comprises phase shifters for adjustable beam steering.

10. Group antenna according to claim 1, wherein the network further comprises means for adjustable power splitting.

11. Group antenna according to claim 1, wherein the first and second coaxial cables having different phase velocities are extended or shortened, specifically by n×360°, where n=1, 2 . . . .

12. Group antenna according to claim 1, wherein the first and second coaxial cables having different phase velocities, when receiving or emitting an inverted signal, with a phase shift of 180° are extended or shortened, specifically by 180°+n×360°, where n=1, 2 . . . .

13. Group antenna according to claim 1, wherein the network comprises a plurality of branch points in the form of splitters or combiners, where said plurality of branch points form supply points, connection points or the radiator feed points.

14. Group antenna according to claim 1, wherein the first and second coaxial cables have an inner conductor that is in the form of a helix or has an undulating design.

15. Group antenna comprising:

a first radiator having a first radiator feed point;

a second radiator having a second radiator feed point;

a third radiator having a third radiator feed point, the first, second and third radiators spaced apart from each other;

a splitter or combiner; and a feed network configured for feeding the first, second and third radiators, the feed network comprising a first flexible coaxial cable which provides a first path running between the splitter or combiner and the first radiator feed point, a second flexible coaxial cable which provides a second path running between the splitter or combiner and the second radiator feed point, and a third flexible coaxial cable which provides a third path running between the splitter or combiner and the third radiator feed point, the first, second and third coaxial cables being connected in parallel to the splitter or combiner so that the first path is not serial with the second or third path; the first, second and third coaxial cables being of different types, having different lengths and exhibiting different characteristic phase velocities, at least two of the radiators being fed with different phases, and at least one of the first, second and third coaxial cables comprising a coaxial cable having a low phase velocity at least over a sub-length in order to shorten the overall cable length between the splitter or combiner and the first, second or third radiator feed point.

16. The group antenna of claim 15 wherein at two of the first, second and third paths have the same physical length.

* * * * *